US007137215B1

(12) United States Patent
Chuang

(10) Patent No.: US 7,137,215 B1
(45) Date of Patent: Nov. 21, 2006

(54) ANIMATION FRAME

(75) Inventor: Tony Chuang, Taipei Hsien (TW)

(73) Assignee: Trusty Industrial Inc., Taipei Hsien (TW)

( * ) Notice: Subject to any disclaimer, the term of this patent is extended or adjusted under 35 U.S.C. 154(b) by 0 days.

(21) Appl. No.: 11/234,192

(22) Filed: Sep. 26, 2005

(51) Int. Cl.
*G09F 19/00* (2006.01)

(52) U.S. Cl. ..... 40/436; 40/453; 40/466

(58) Field of Classification Search ..... 40/436, 40/453, 454, 463, 466, 614; 340/815.86
See application file for complete search history.

(56) References Cited

U.S. PATENT DOCUMENTS

| | | | | |
|---|---|---|---|---|
| 2,098,143 | A * | 11/1937 | Grey et al. | 40/614 |
| 4,803,791 | A * | 2/1989 | Dell'Acqua | 40/433 |
| 6,034,609 | A * | 3/2000 | Comiskey, Jr. | 340/631 |
| 6,226,906 | B1 * | 5/2001 | Bar-Yona | 40/454 |
| 2004/0231206 | A1 * | 11/2004 | Liebman et al. | 40/453 |

* cited by examiner

*Primary Examiner*—J J Swann
*Assistant Examiner*—Mark T. Vogelbacker
(74) *Attorney, Agent, or Firm*—Troxell Law Office, PLLC

(57) ABSTRACT

An animation frame including a front frame body, a back plate installed therein with a grating plate and frame brackets, a moveable plane plate stuck with pictures, a battery, an IC circuit board and coils etc. The grating plate is placed on the pictures on the plane plate and fixed on a main body of the back plate; the plane plate has two notches respectively on its upper and lower edges, a vertical plane perpendicular to the plane plate has thereon a magnet between the two coils of the main body. The main body has thereon a movable device connecting with a movable screw and being fixed or adjusted to slide left or right to adjust the angular position of the plane plate. The main body has therein two movable screws connectable with the main body to adjust the plane plate in up and down moving. The magnet is provided at suitable distances from its two lateral sides each with a coil controlled by an IC circuit to generate an S or N polarity, according to the principle of "like charges repel while unlike charges attract", the pictures can move to and fro between two fixed positions, so that effects that the two pictures are changed within a short duration when they are alternately changed with each other and the two pictures are entirely presented in long durations can be achieved.

3 Claims, 7 Drawing Sheets

ANIMATION FRAME

BACKGROUND OF THE INVENTION

1. Field of the Invention

The present invention is related to an improved animation frame, and especially to an improved animation frame having effects that two pictures alternately change and the two pictures can be entirely presented for long durations.

2. Description of the Prior Art

It is clearly seen from the name "animation frame" that the frame is similar to a conventional frame for pictures except that it is mounted therein with some electric elements to increase some specific effects, thereby its basic structure also has three parts including a front frame body, a back plate and frame brackets. The front frame body and the frame brackets of the present invention use a technique of conventional frames, and the present invention only has an improvement in the internal devices in its back plate.

Conventional animation frames made by various manufacturers available presently are different but are only based on a principle, namely, its grating plate is separated from its pictures, the grating plate is fixed and the motor moves a plane plate stuck thereon with the pictures; thereby viewers can see a nonstop changing of the pictures at an unmoved position. In this structure, the motor rotates with a fixed speed to render an eccentrically rotating round member with an axle as a rotating center to drive the pictures to get an effect of alternately changing. The conventional structure has a defect: the durations for entirely presenting the pictures before they get into the processes of alternately changing are short; thus the important effect for customers to clearly see the contents of the advertisements is unable to get.

Referring to FIG. 7 that shows angular adjustment of a conventional structure, in which a hollow turning cylinder 401 is mounted thereon with a protruding cylindrical post 402 to drive a plane plate stuck with pictures to change its angular position; the hollow turning cylinder 401 is slipped over a protruding cylindrical rotating axle 403 on a main body of a back plate, the largest adjusting distance of the plane plate stuck with pictures equals to the diameter of the hollow turning cylinder 401. The distance for adjusting in such a structure is short, thus the angle changeable of the plane plate stuck with pictures is small, and a defect that the pictures are unaligned with the grating plate is subjected to being occurred.

SUMMARY OF THE INVENTION

In order to get rid of the defect, the present invention is installed on the bottom of the plane plate with a magnet which is provided at suitable distances from its two lateral sides each with a coil, the two coils are controlled by an IC circuit to generate an S or N polarity, according to the principle of "like charges repel while unlike charges attract", the two pictures can move to and fro between two fixed positions, so that the effects that the two pictures are changed within a short duration when they are alternately changed with each other and the two pictures are entirely presented in long durations can be achieved.

Further, the present invention provides a movable device positioned on two mutually parallel strip like members, the movable device has thereon a protruding cylindrical post in cooperation with a hole provided on the top of a movable plane plate stuck thereon with the pictures, therefore, the length for adjustment is long, this can render the plane plate stuck thereon with the pictures to move a very large angle to change its angular position for adjusting the pictures to correct positions.

The present invention will be apparent after reading the detailed description of the preferred embodiment thereof in reference to the accompanying drawings.

DETAILED DESCRIPTION OF THE PREFERRED EMBODIMENT

The front frame body and the frame brackets of the present invention use a conventional technique; and the present invention only has an improvement in the internal devices in the back plate of the frame. The front frame body can be made of wood, plastic, and crystal etc.

Electric control elements of the conventional animation frames available presently mostly are mounted on the back plate of the frame; the present invention is same in this aspect; the present invention only makes an improvement in the modes of controlling for correcting angular position of a plane plate stuck with pictures and of movement of the plane plate.

Figure 1:
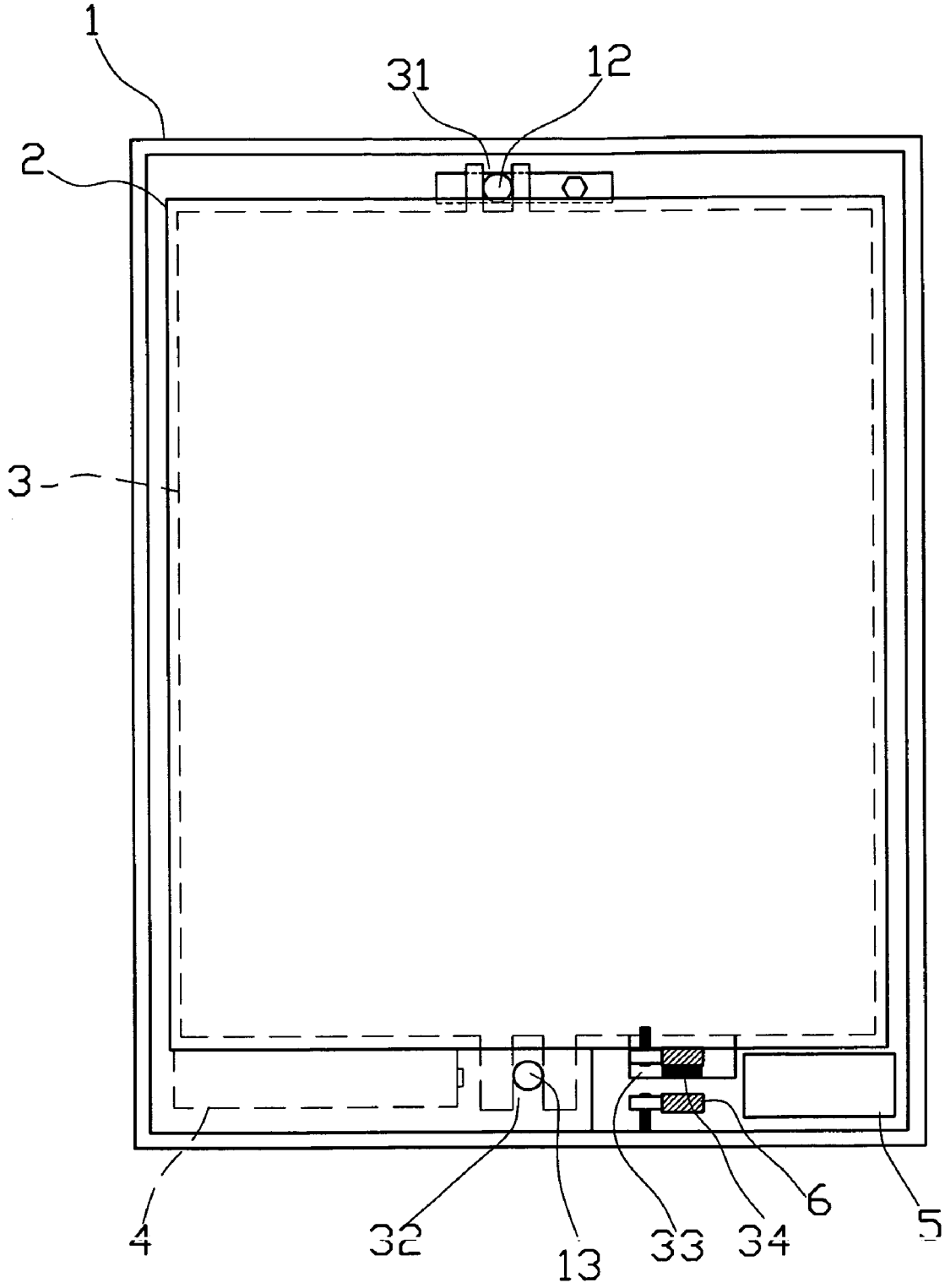
FIG. 1 is a plan view showing assembling of a main body of a back plate of the frame of the present invention.
Figure 2:
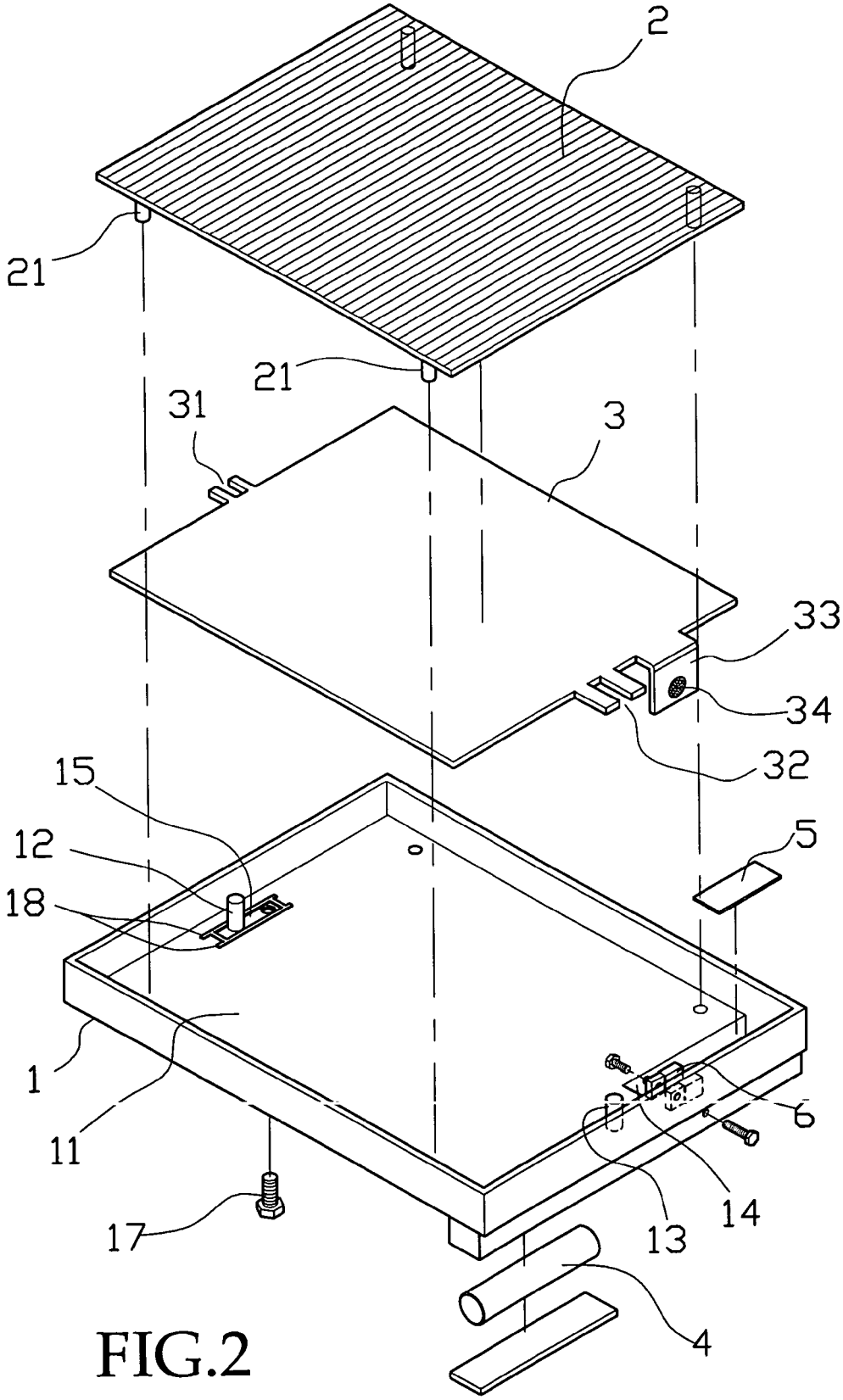
FIG. 2 is an anatomic perspective view showing the interior of a main body of the back plate of the frame of the present invention.
Figure 3:
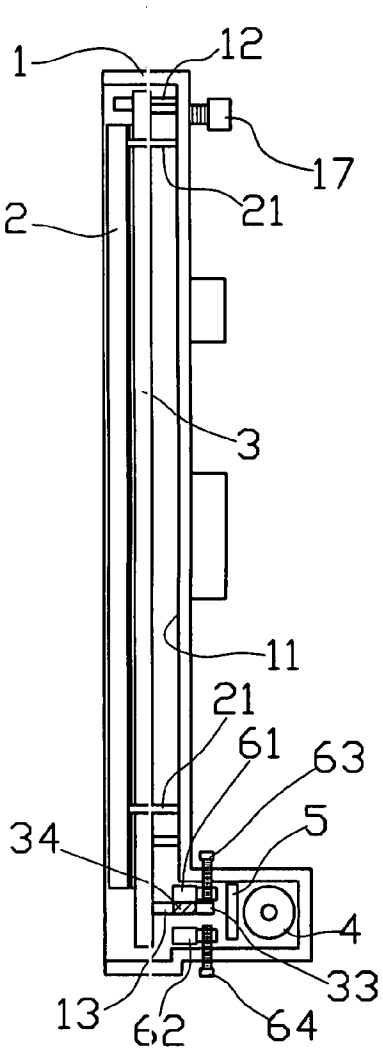
FIG. 3 is a sectional view of FIG. 1.

Referring to FIGS. 1 to 3 showing the interior basic allocation of the back plate of the frame, a main body 1 of the back plate is made by injection molding of plastic; the main body 1 has therein space and suitable supporting spots for accommodating electric elements including a grating plate 2, a moveable plane plate 3 stuck with pictures, a battery 4, an IC circuit board 5 and coils 6 etc.

The grating plate 2 as shown in FIG. 2 is placed on the pictures on the moveable plane plate 3 stuck with the pictures; the main body 1 of the back plate is fixed and unmoved, it can be seen in the drawing that a plurality of protruding posts 21 on the back side of the grating plate 2 abut against holes in an inner surface 11 of the main body 1 of the back plate to make fixed of the plane plate 3.

The moveable plane plate 3 stuck with the pictures shown in FIG. 2 has near its upper edge a notch 31, and also has near its lower edge a notch 32; the function of the two notches 31, 32 is to slip over protruding positioning cylindrical-posts 12, 13 when they are mounted on the main body 1 of the back plate, thereby the moveable plane plate 3 stuck with the pictures has a fixed rail when it is moved up and down under control of the notches 31, 32 without deviation from the determined direction. A bottom surface of the plane plate 3 is provided at a position with an "L" shaped folded plate 33 located nearer to the right; a vertical plane of the folded plate 33 has a magnet 34; the vertical plane of the folded plate 33 is perpendicular to the plane plate 3.

Figure 4:
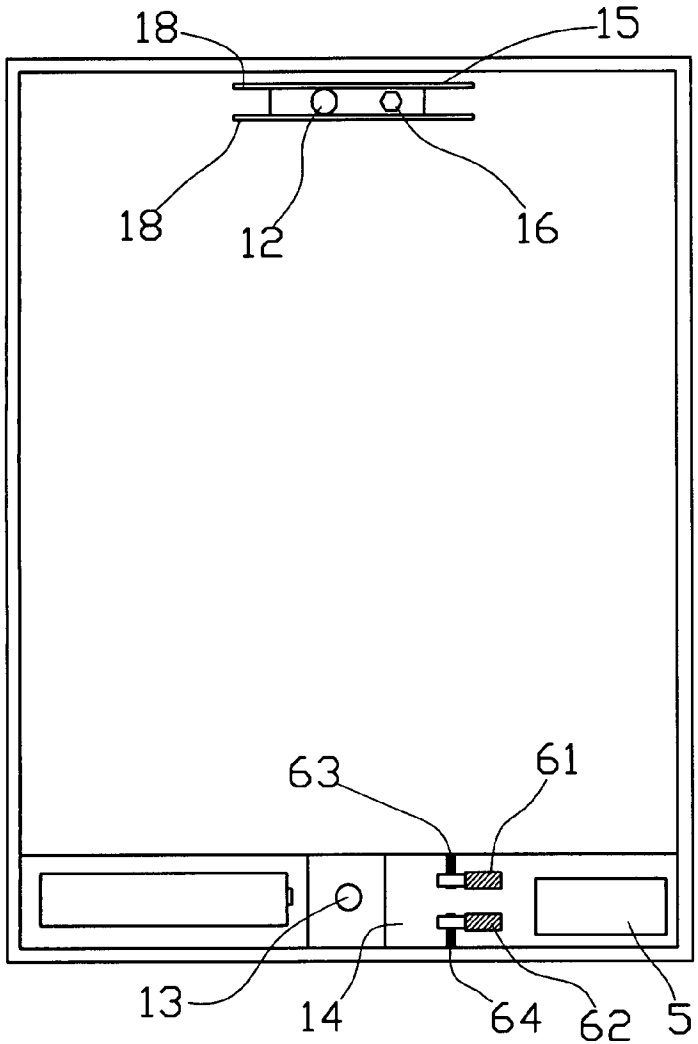
FIG. 4 is a plan view showing a main body of a back plate of the frame of the present invention.
Figure 4A:
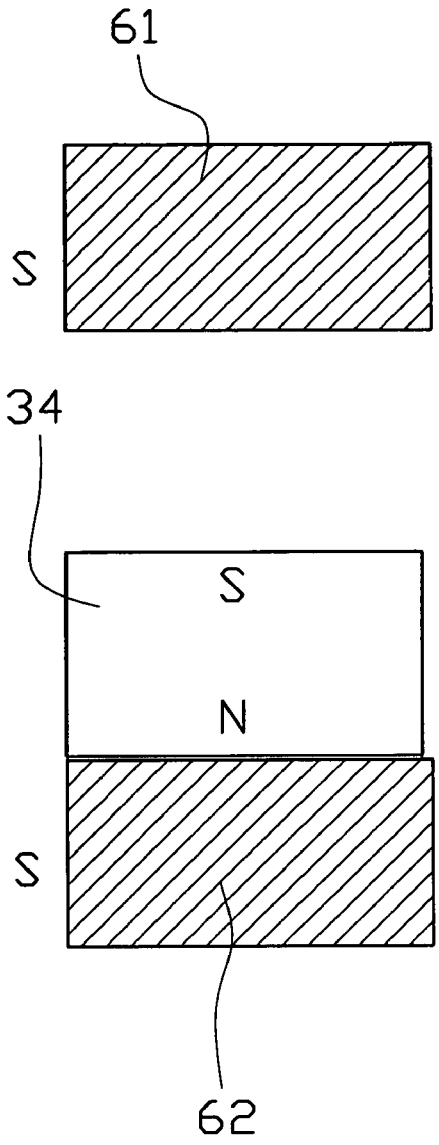
FIGS. 4A and 4B are schematic views showing actions in operation of a magnet and coils of the present invention.
Figure 4B:
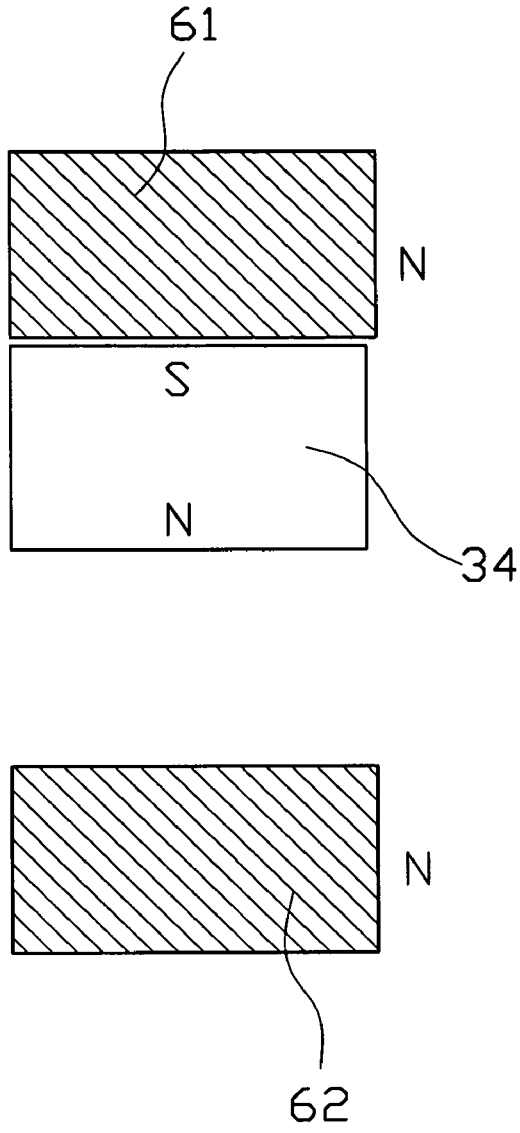
Figure 5A:
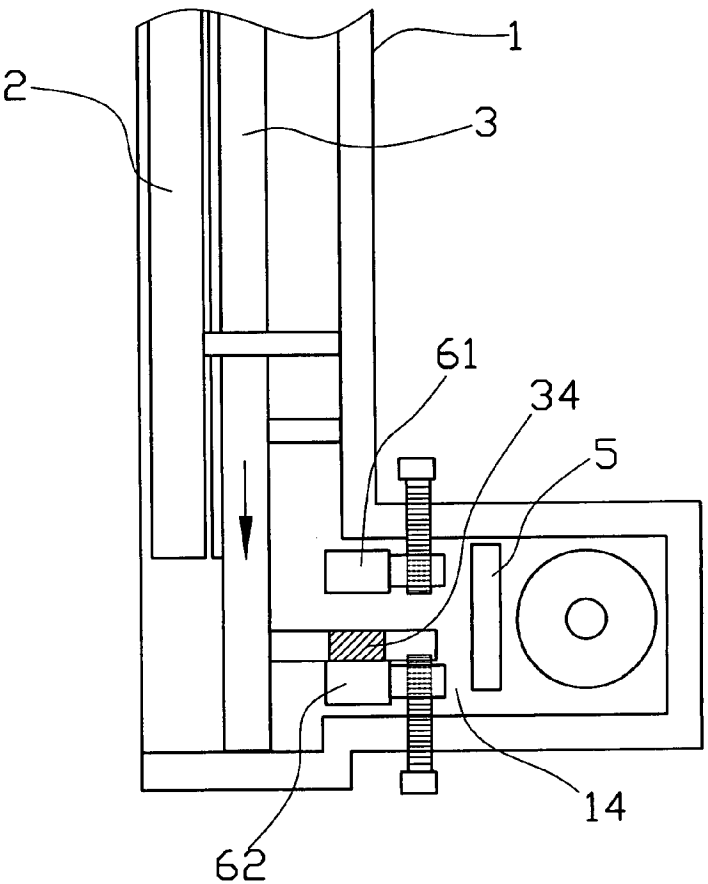
FIGS. 5A and 5B are schematic views showing actions in operation of the present invention.
Figure 5B:
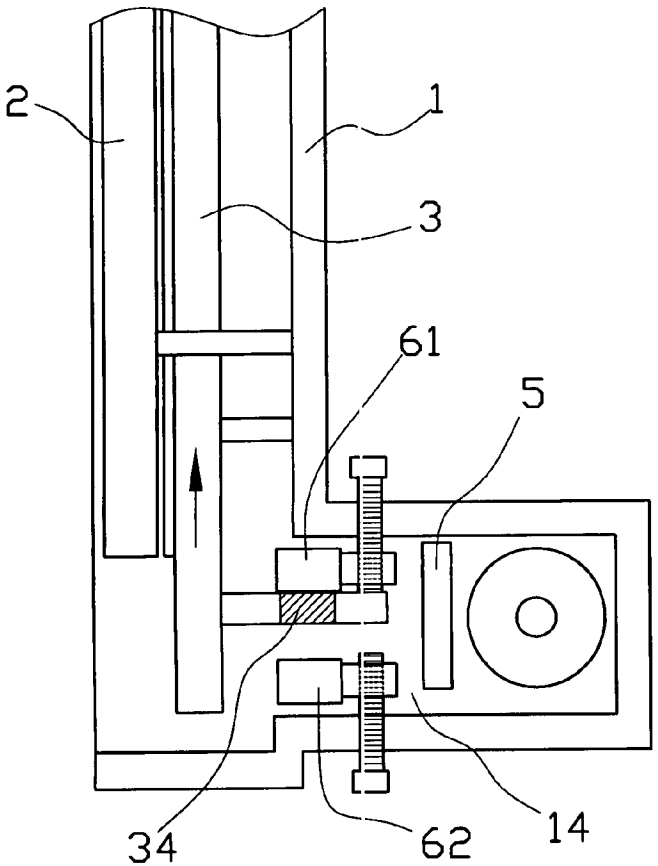

Referring to FIGS. 2 and 4 showing the interior installation of the main body 1 of the back plate, the protruding positioning cylindrical-post 13 provided at the lower side of the main body 1 is used for slipping thereover of the notch 32 at the lower side of the moveable plane plate 3, two coils 61, 62 are separated for a suitable distance and fixed in a recess 14 provided at the lower side of the main body 1 of the back plate. When the moveable plane plate 3 is mounted on the main body 1 of the back plate, the magnet 34 on the moveable plane plate 3 is exactly between the two coils 61, 62 (referring to FIG. 3). In practical use, the present invention can be designed to render the magnet 34 mounted between the two coils 61, 62 to be attracted by the lower coil 62 when an IC circuit controls to turn both the two coils 61, 62 into S polarity simultaneously, such as are shown in FIGS. 4A and 5A; when a set time is due, the IC circuit controls to turn both the two coils 61, 62 into N polarity simultaneously, the magnet 34 is attracted by the upper coil 61, such as are shown in FIGS. 4B and 5B. By circuit control of the IC circuit board 5, the moveable plane plate 3 stuck with the pictures can be continuously moved up and down to continuously change the pictures by moving the grating plate 2, and an effect of having animation pictures can be obtained.

Movable screws 63 and 64 function for positioning to get the best positioned points of the folded plate 33 of the plane plate 3 which is moved up and down; thereby the two pictures can stay at positions for entirely presenting.

The main body 1 of the back plate has on its top surface an adjusting sheet 15 movably mounted, the adjusting sheet 15 has thereon the protruding cylindrical post 12 for slipping thereover of the notch 31 at the upper side of the moveable plane plate 3, thereby the moveable plane plate 3 stuck with the pictures has a positioning rail when it is moved up and down. A fixed nut 16 is installed near the cylindrical post 12 for screwing therein of a movable screw 17 (referring to FIGS. 2 and 3), the purpose of the designing of the movable device is that: when the veins of the pictures on the moveable plane plate 3 stuck with the pictures is not completely parallel to those of the grating plate 2 and affects the effects of presenting the pictures, the adjusting sheet 15 can be adjusted and slide leftwards or rightwards, the protruding cylindrical post 12 thus moves the plane plate 3 stuck with the pictures and changes its angular position; when it is adjusted to get a correct angular position, and the movable screw 17 is screwed tight, the moveable plane plate 3 stuck with the pictures can no more be changed, the movable screw 17 completes the movable device by being screwed in to lock into the nut 16 from an elongate hole 19 on the bottom surface of the main body 1 of the back plate (referring to FIG. 6).

Figure 7:
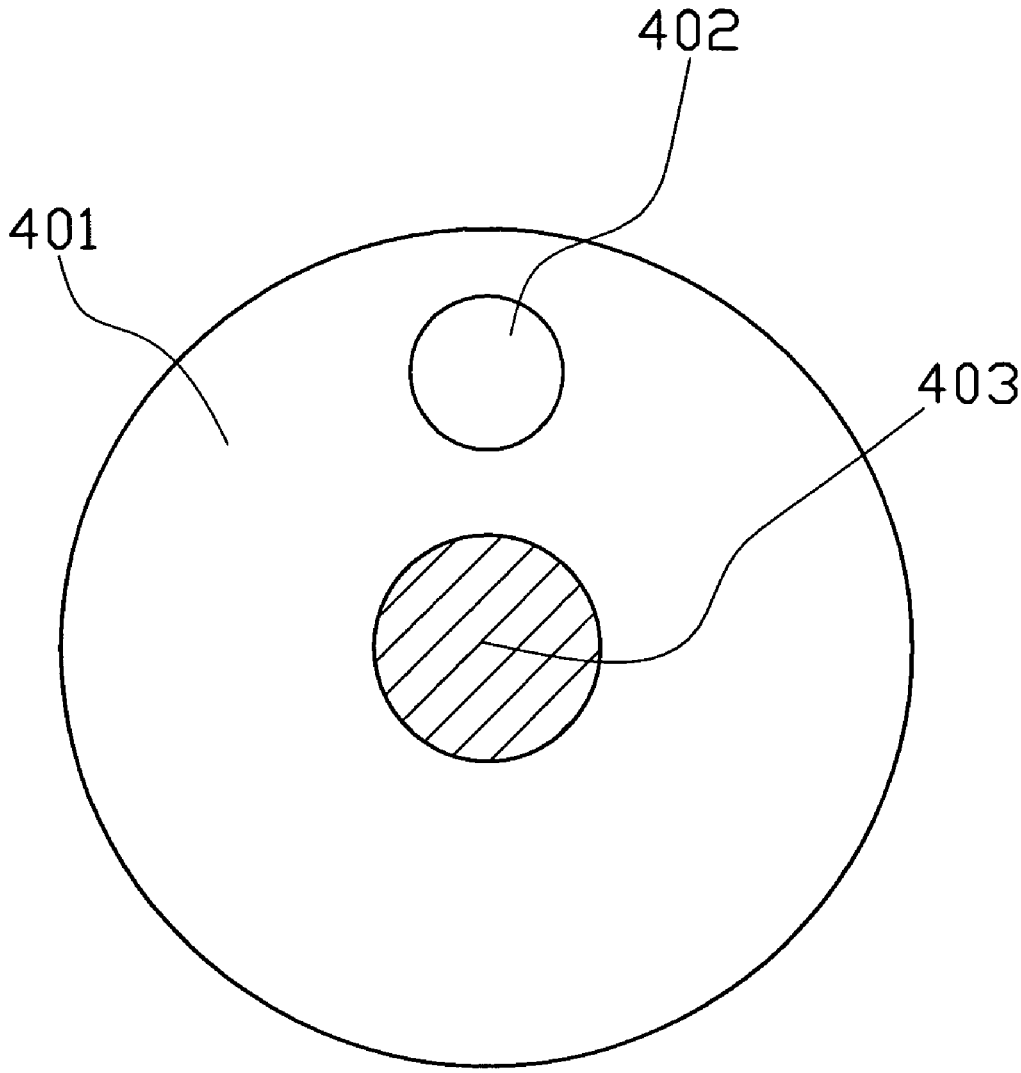
FIG.7 PRIOR ART
FIG. 7 is a plan view showing a conventional angle adjustment device.

This improved movable device has two different aspects from the conventional adjusting devices with the similar function: One is that when the improved movable device of the present invention is under adjusting, it is adjusted linearly leftwards or rightwards, and is positioned by two parallel strip like members 18 on the main body 1 of the back plate for adjusting distance, this can very largely change the angular position of the plane plate 3 stuck with the pictures; the conventional adjusting devices (referring to FIG. 7) is a round hollow turning cylinder 401 that is mounted thereon with a protruding cylindrical post 402 to drive the plane plate 3 stuck with pictures to change its angular position; the hollow turning cylinder 401 is slipped over a protruding cylindrical rotating axle 403 on a main body 1 of the back plate, the largest adjusting distance of the rotating axle 403 equals to the diameter of the hollow turning cylinder 401. A short adjusted distance makes the plane plate 3 stuck with pictures moved to change only a small angular position. The other one is that the movable screw 17 of the present invention can completely fix the adjusting sheet 15 of the movable device; while the conventional structure does not have the function of fixing and adjusting a rotating axle, once in shaking, the angular position of the plane plate 3 stuck with the pictures is changed and must be readjusted; thereby this is another point of designing of the present invention.

Figure 6:
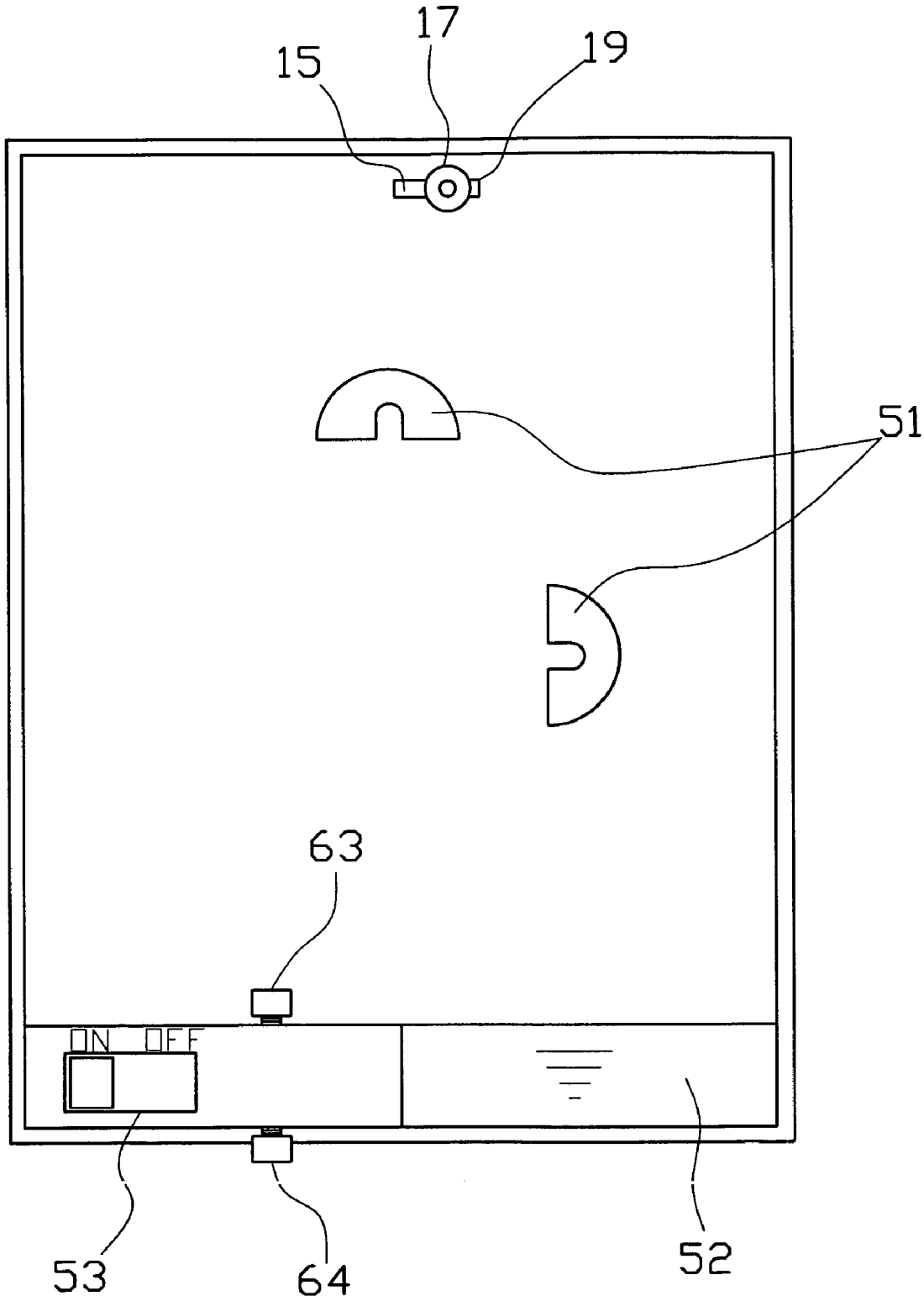
FIG. 6 is a rear view of the frame of the present invention.

Referring to FIG. 6 showing the exterior portion of the main body 1 of the back plate, there are two frame-bracket seats 51 provided for mounting the frame brackets in a longitudinal or a transverse mode, a movable battery lid 52 in benefit to changing the battery 4, as well as an exposed switch 53 for turning on/off the electric power.

By controlling of the IC circuit, the plane plate 3 stuck with the pictures can have its picture presenting times set for moving and for stopping for entirely presenting the two different pictures, this can get the effect that the two pictures are changed within a short duration when they are alternated with each other and entirely presented in long durations.

What are shown in the drawings are only for illustrating a preferred embodiment of the present invention, easy changes according to the idea of the present invention, such as to change the moving element to a grating plate or to change the battery to a publicly supplied electric power etc. all fall within the scope of the appended claims and are intended to form part of this invention.

Accordingly, the improved animation frame of the present invention completely meets the requirement for patent application.

What we claim as new and desire to be secured by Letters Patent of the United States is:

1. An improved animation frame comprising:

a main body having a grating plate and a moveable plane plate having two pictures, said two pictures on said movable plane plate are presented through different areas on said grating plate, wherein said main body is provided therein with two coils separated a distance from each other, a battery and an IC circuit board, said moveable plane plate is installed with a magnet between said two coils; said IC circuit board generates an S or N polarity, according to a principle of "like charges repel while unlike charges attract", said magnet operates to move said moveable plane making said two pictures move to and fro between two fixed positions, wherein said moveable plane plate has two notches respectively on its upper edge and its lower edge to respectively slip over protruding positioning cylindrical-posts extending from said main body, so that said moveable plane plate is limited to move up and down, wherein said main body is provided with a movable device for adjusting angular position of said moveable plane plate against said grating plate, said movable device is provided between two mutually parallel strip members with a slidable adjusting sheet, said upper protruding positioning cylindrical-post is provided on said adjusting sheet, and a movable screw is connected to a nut on said adjusting sheet from an elongate hole on a bottom surface of said main body, thus said upper protruding positioning cylindrical-post is positioned to adjust angular position of said moveable plane plate.

2. An improved animation frame as claimed in claim 1, wherein said moveable plane plate having two pictures is provided with a folded plate; said magnet is provided on said folded plate.

3. An improved animation frame as claimed in claim 1, wherein said two coils are provided in a recess of said main body, movable screws are provided respectively on two sides of said recess for adjusting positions of said movable plane plate.

* * * * *